US010934807B2

(12) United States Patent
Anderson et al.

(10) Patent No.: US 10,934,807 B2
(45) Date of Patent: Mar. 2, 2021

(54) HORIZONTAL DIRECTIONAL DRILL RIG HEATING SYSTEM

(71) Applicants: Kaz Jon Anderson, Saginaw, MN (US); Terry Jon Anderson, Saginaw, MN (US); Jed Daniel Graves, Proctor, MN (US); Dexter James Anderson, Saginaw, MN (US)

(72) Inventors: Kaz Jon Anderson, Saginaw, MN (US); Terry Jon Anderson, Saginaw, MN (US); Jed Daniel Graves, Proctor, MN (US); Dexter James Anderson, Saginaw, MN (US)

(73) Assignee: Kaz Jon Anderson, Saginaw, MN (US)

( * ) Notice: Subject to any disclaimer, the term of this patent is extended or adjusted under 35 U.S.C. 154(b) by 199 days.

(21) Appl. No.: 16/232,027

(22) Filed: Dec. 25, 2018

(65) Prior Publication Data

US 2020/0199974 A1 Jun. 25, 2020

(51) Int. Cl.

| | |
|---|---|
| ***E21B 36/00*** | (2006.01) |
| ***E21B 41/00*** | (2006.01) |
| ***F28D 15/02*** | (2006.01) |
| *E21B 7/04* | (2006.01) |

(52) U.S. Cl.

CPC ..... *E21B 36/00* (2013.01); *E21B 41/00* (2013.01); *F28D 15/02* (2013.01); *E21B 7/046* (2013.01)

(58) Field of Classification Search

CPC .... B60H 1/2203; B60H 1/2209; B60R 16/08; E21B 7/046; E21B 17/00; E21B 17/06; E21B 17/18; E21B 36/00; E21B 41/00; F28D 15/02; F28F 17/00; B64C 1/067; B64C 39/001

USPC ..... 237/80, 5, 34; 244/134 R, 134 C

See application file for complete search history.

(56) References Cited

U.S. PATENT DOCUMENTS

| | | | | | |
|---|---|---|---|---|---|
| 206,357 | A * | 7/1878 | Rogers | F16L 53/32 | 138/32 |
| 2,130,131 | A * | 9/1938 | Hirshfeld | B61D 23/00 | 105/443 |
| 7,673,832 | B2 * | 3/2010 | Meister | B64C 21/08 | 244/123.1 |
| 7,708,227 | B2 * | 5/2010 | Al-Khalil | B64D 15/22 | 244/134 D |
| 8,096,508 | B2 * | 1/2012 | Marx | C09J 7/38 | 244/134 E |
| 8,931,252 | B2 * | 1/2015 | Richardson | F02C 7/04 | 60/39.093 |
| 2002/0027180 | A1 * | 3/2002 | Porte | B64D 15/04 | 244/134 R |
| 2002/0139900 | A1 * | 10/2002 | Porte | B64D 15/04 | 244/134 C |
| 2005/0029403 | A1 * | 2/2005 | Bourgault | B64F 5/27 | 244/134 C |

(Continued)

*Primary Examiner* — Daniel E. Namay

(57) ABSTRACT

A horizontal direction drill rig heating system for efficiently keeping the drill carriage frame and other major components that are crucial for the drilling process free of snow and ice buildup during freezing conditions. The horizontal directional drill rig heating system includes a horizontal directional drill rig manufactured from structural tubing, a working fluid reservoir, a pump, an inverter, a heater, on/off valves, hoses, and multiple heating circuits on the horizontal directional drill rig to heat the entire horizontal directional drill rig during freezing conditions.

2 Claims, 7 Drawing Sheets

(56) References Cited

U.S. PATENT DOCUMENTS

2013/0269792 A1* 10/2013 Peitz ..... E21B 41/00
137/334

* cited by examiner

HORIZONTAL DIRECTIONAL DRILL RIG HEATING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates specifically to horizontal directional drill (HDD) rigs for efficiently keeping the drill carriage frame and other major components that are crucial for the drilling process free of snow and ice buildup during freezing conditions.

2. Description of the Related Art

Heating devices and processes have been in use for many years in order to successfully operate a horizontal directional drill rig during freezing conditions. Typically, heating devices and processes include many various apparatuses (i.e. remote heaters with fans blowing across the machine, fully enclosing the drill rig with a temporary heated shelter, etc.). The carriage rail that supports the drills carriage which moves back and forth placing or removing drill rod in or out of the earth on the drill rig structure, along with many of the drill rig structural components, are generally manufactured from various sized structural steel tubing. The carriage rail structure is susceptible to ice buildup during freezing conditions when the carriage decouples itself from the drill rods. During the decoupling of the drill rods and the carriage moving from one end of the rail to the other end of the rail structure, residual drilling fluid (i.e. a combination of water and a drilling solution mixture) drips onto the rail structure and freezes during freezing conditions. The buildup of ice on the carriage rail structure may cause severe mechanical wear issues for the drill rig carriage, or it may require the drill rig to be shut down completely until the ice is removed from the structure. Both the mechanical wear of the drill rig carriage and the shutting down of a horizontal direction drill rig can lead to major undesired ownership expenses.

Horizontal directional drill rigs and the surrounding area around the drill rigs are generally covered in drilling fluid during the drilling process, which makes it extremely difficult to use a heating system open to the environment (i.e. remote heaters combined with fans) that are prone to mechanical failure once the drilling fluid contacts them. Horizontal directional drill rigs are also generally mobile in design, so the use of temporary heated shelters become inefficient and unnecessarily expensive during machine setup and tear down.

While the combination of heaters, fans, and heated shelters may be suitable for some applications, they are not suitable for efficiently keeping a horizontal directional drill rig structure from freezing during severe weather conditions. Heating a horizontal directional drill rig structure with heating methods open to the environment (i.e. mobile heaters with fans, shelters, etc.) can be very time consuming during setup or teardown and may be susceptible to failure due to the harsh environment around the drill rig.

In these respects, the horizontal directional drill rig heating system according to the present invention substantially departs from the conventional concepts and designs of the prior art, and in so doing provides a heating system primarily developed for the purpose of efficiently keeping a horizontal directional drill rig structure free from snow and ice buildup during harsh weather conditions.

BRIEF SUMMARY OF THE INVENTION

In view of the foregoing disadvantages inherent in the known types of horizontal directional drill rig heating systems now present in the prior art, the present invention provides a new horizontal directional drill rig heating system construction wherein the same can be utilized for efficiently keeping the buildup of snow and ice from accumulating on the drill rig structure during harsh weather conditions.

The general purpose of the present invention, which will be described subsequently in greater detail, is to provide a new directional drill rig heating system that has many of the advantages of the heating systems heretofore and many novel features that result in a new directional drill rig heating system which is not anticipated, rendered obvious, suggested, or even implied by any of the prior art heating systems, either alone or in any combination thereof.

To attain this, the present invention generally comprises a fluid reservoir to provide working fluid to the system, a pump, an inverter, a heater, on/off valves to control the path of fluid flow, hoses to transfer the fluid, a horizontal directional drill rig structure comprised of structural tubing, reflective insulating layer on the horizontal directional drill rig, and a working fluid (i.e. water and glycol solution) to transmit radiant heat throughout the drill rig structure via internal forced convection of the drill rig structure in order to keep the structure free from snow and ice. The invention also keeps the stored drilling rods on the horizontal directional drill rig free from ice buildup on the drilling rod internals when the rods are removed from the drill carriage and placed onto the horizontal directional drill rod storage area to drip dry.

There has thus been outlined, rather broadly, the more important features of the invention in order that the detailed description thereof may be better understood, and in order that the present contribution to the art may be better appreciated. There are additional features of the invention that are not stated above that will be described hereinafter and that will form the subject matter of the claims appended hereto.

In this respect, before explaining at least one embodiment of the invention in detail, it is to be understood that the invention is not limited in its construction and to the arrangements of the components set forth in the following description or illustrated in the drawings on horizontal direction drill rigs. The invention is capable of other embodiments and of being practice and carried out in various ways. Also, it is to be understood that the phraseology and terminology employed herein are for the purpose of the description and should not be regarded as limiting.

A primary objective of the present invention is to provide a horizontal directional drill rig heating system that will overcome the shortcomings of the prior art devices and systems.

A secondary objective of the present invention is to provide a horizontal direction drill rig heating system for efficiently removing the buildup of snow and ice on the horizontal directional drill rig structure.

A tertiary objective is to provide a horizontal directional drill rig heating system that is closed off from the external environment to prevent inefficiencies and destruction of components in the harsh drilling environment near the drill rig (i.e. drilling fluid overspray, rain, sleet, etc.).

A quaternary objective is to provide a horizontal direction drill rig heating system that is securely attached to the drill rig structure to avoid costly setup and removal time, so as to be able to be mobile with the drill rig, as a majority of horizontal directional drill rigs are mobile in their design.

A further objective is to provide a simple, easily serviceable, horizontal directional drill rig heating system that is relatively compact in its entirety to avoid large space claim on the horizontal directional drill rig.

Other objectives and advantages of the present invention will become obvious to the reader and it is intended that these objectives and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
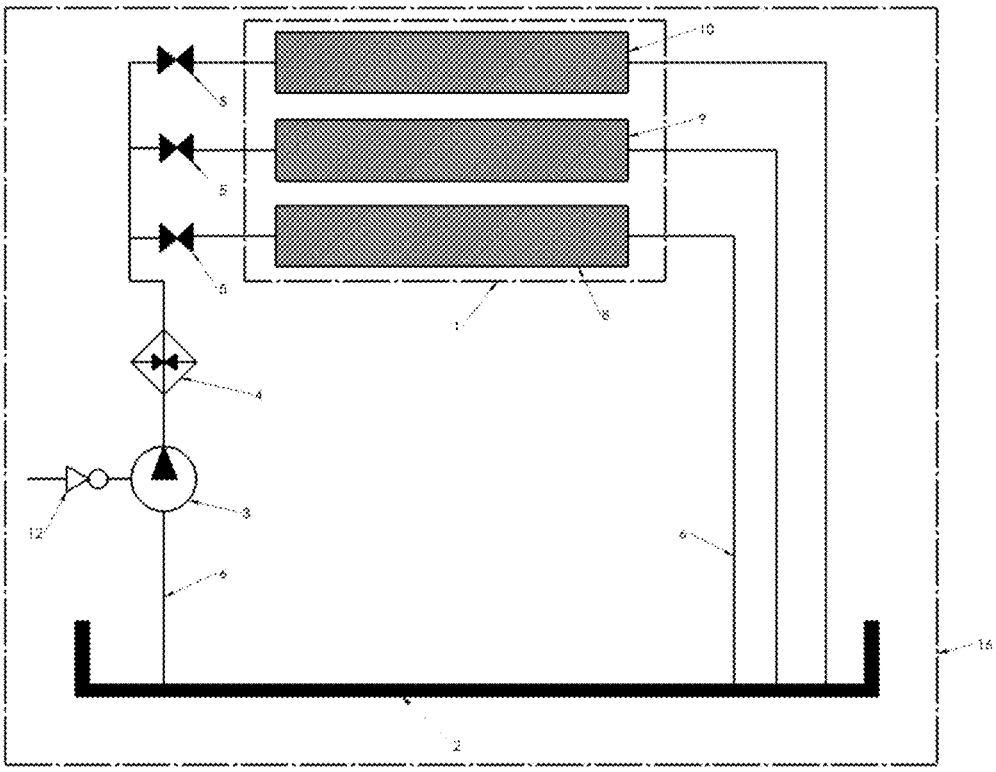
FIG. 1 is an overview system schematic of the present invention.

Turning now descriptively to the drawings, in which similar reference characters denote similar elements through the several figures. FIGS. 1 through 7 illustrate a horizontal directional drill rig heating system 16, which comprises a horizontal directional drill rig 1, a fluid reservoir 2 that supplies working fluid to the system 16, a pump 3 to move the working fluid throughout the system 16, an inverter 12 to convert the drill rig's 1 direct current (DC) electrical system to alternating current (AC) in order to run the pump 3, a heater 4 to heat up the working fluid, on/off valves 5 to direct the flow to specific circuits on the horizontal directional drill rig 1, reflective insulating layers 17 to directed the heat to specific areas, hoses 6 to transfer fluid from general components stated above to the drill rig carriage structure 8, auxiliary drill rig structure 9, and auxiliary heating components 10.

B. Horizontal Directional Drill Rig

Figure 2:
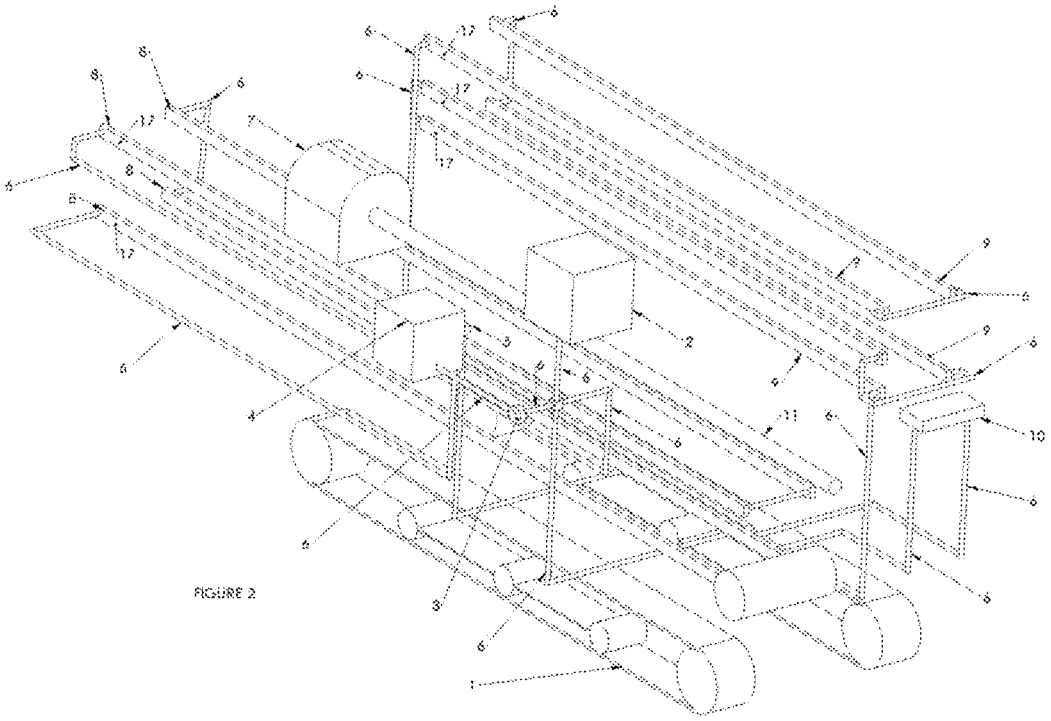
FIG. 2 is an overview of all the major components of the present invention.
Figure 3:
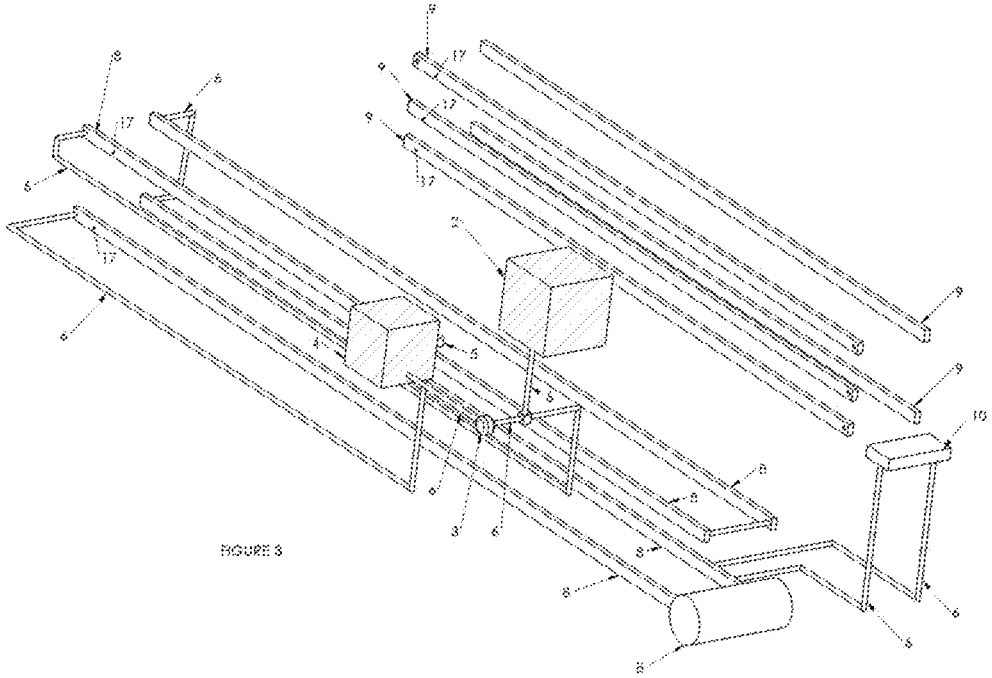
FIG. 3 is an overview of the system with the carriage structure and auxiliary components circuit of the present invention.
Figure 4:
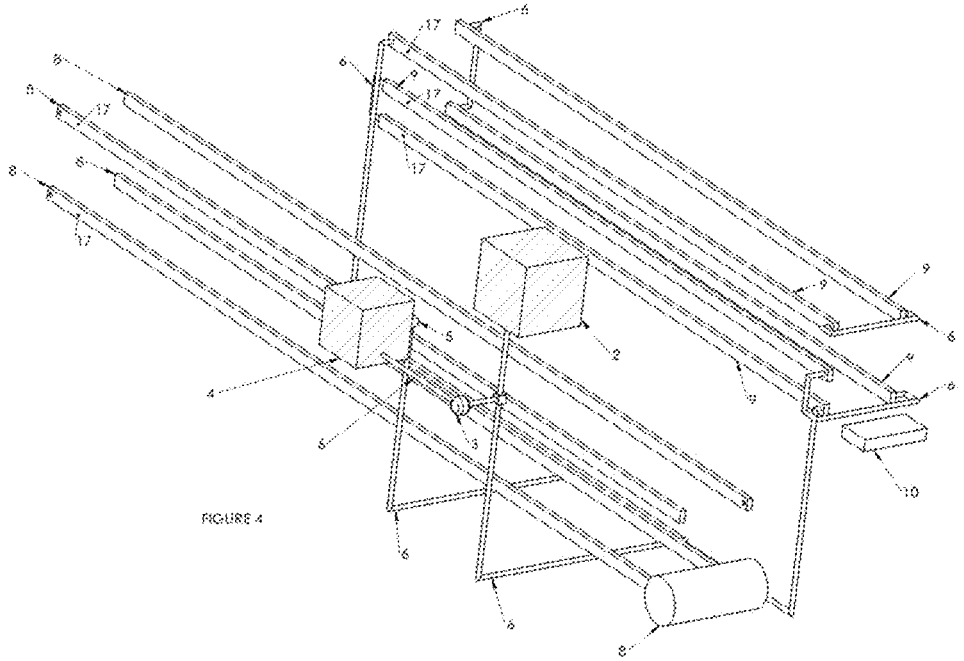
FIG. 4 is an overview of the system with the auxiliary drill structure circuit of the present invention.

The horizontal directional drill rig 1 is generally comprised of structural tubing to make up the drill rig carriage structure 8, auxiliary drill rig structures 9, and auxiliary heating components 10, as shown in FIGS. 1 through 4. Reflective insulating layers 17 are strategically placed on the horizontal drill rig 1 as shown in FIGS. 2, 3, and 4 to direct the radiant heat transfer to specific areas on the horizontal direction drill rig 1. Depending on the drill rig 1 layout from the multiple manufacturers of these horizontal direction drill rigs 1, the components that make up the horizontal directional drill rig heating system 16, as stated above in the overview, can be mounted directly onto the drill rig 1 or remotely off the drill rig 1 with the hoses 6 connecting the system 16 to the drill rig carriage structure 8, auxiliary drill rig structures 9, and auxiliary heating components 10 as shown in FIGS. 2 through 4.

C. Drill Rig Carriage Circuit

Figure 5:
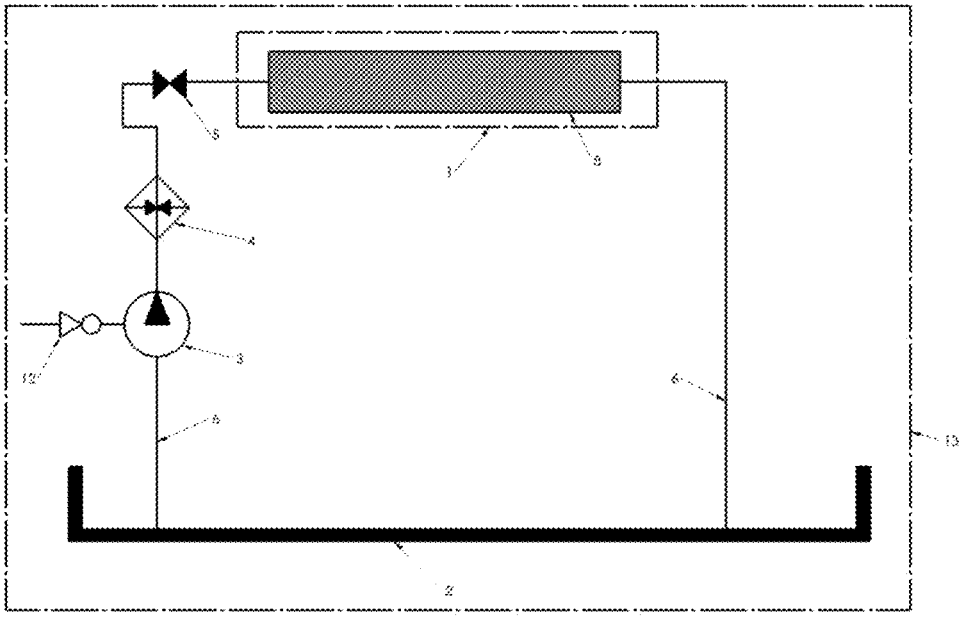
FIG. 5 is an overview schematic of the drill rig carriage structure circuit.

The drill rig carriage circuit 13 is comprised of the fluid reservoir 2, the pump 3, the heater 4, on/off valves 5, hoses 6, and the drill rig carriage structure 8 that is located on the horizontal directional drill rig 1 as shown in FIGS. 1 through 5. The horizontal directional drill rig heating system 16 components 2, 3, 4, 5, and 8 are connected via hoses 6 to create an open-circuit heating system for the drill rig carriage structure 8, as shown in FIG. 5.

D. Drill Rig Auxiliary Structure Circuit

Figure 6:
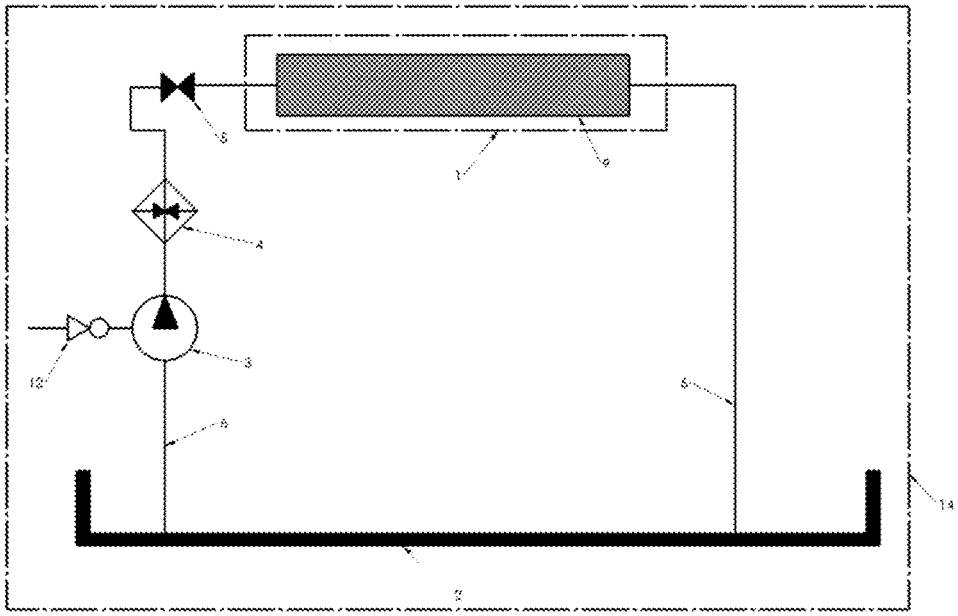
FIG. 6 is an overview schematic of the auxiliary drill rig structure circuit.

The drill rig auxiliary structure circuit 14 is comprised of the fluid reservoir 2, the pump 3, the heater 4, on/off valve 5, hoses 6, and the drill rig auxiliary structure 9 that is located on the horizontal directional drill rig 1 as shown in FIGS. 1, 2, 4, and 6. The horizontal directional drill rig heating system 16 components 2, 3, 4, 5, and 9 are connected via hoses 6 to create a open-circuit heating system for the auxiliary drill rig structure 9, as shown in FIG. 6.

E. Auxiliary Heating Circuit

Figure 7:
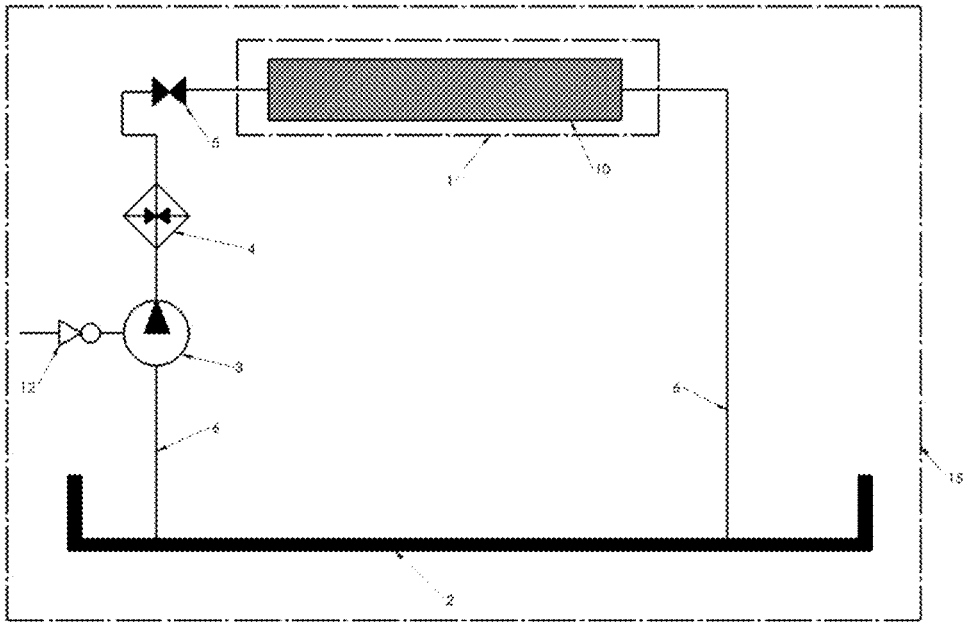
FIG. 7 is an overview schematic of the auxiliary heating components circuit.

The auxiliary heating circuit 15 is comprised of the fluid reservoir 2, the pump 3, the heater 4, on/off valves 5, hoses 6, and the auxiliary heating components 10 that is located on the horizontal direction drill rig 1 as shown in FIGS. 1, 2, and 7. The horizontal direction drill rig heating system 16 components 2, 3, 4, 5, and 10 are connected via hoses 6 to create an open-circuit heating system for the auxiliary heating components 10, as shown in FIG. 7.

F. Horizontal Directional Drill Rig Heating System

The horizontal directional drill rig heating system 16 is comprised of the horizontal direction drill rig 1, the drill rig carriage circuit 13, the drill rig auxiliary structure circuit 14, and the auxiliary heating circuit 15. All three circuits utilize the same fluid reservoir 2, pump 3, inverter 12, heater 4, on/off valves 5, and hoses 6 to make up the horizontal direction drill rig heating system 16. Each individual circuit, drill rig carriage circuit 13, drill rig auxiliary structure circuit 14, and auxiliary heating circuit 15 can be turned on and off via on/off valves 5, as shown in FIGS. 1-7.

G. In Use

In use, the horizontal directional drill rig heating system 16 is turned on before the horizontal directional drill rig 1 needs to operate in freezing conditions in order to remove any snow or ice that has been built up on the horizontal direction drill rig 1. The horizontal directional drill rig heating system 16 can be turned on via manually at the horizontal direction drill rig 1 or remotely with a timer. Once the horizontal direction drill rig heating system 16 is turned on, the heater 4 and pump 3 start the heating process for the drill rig carriage circuit 13, the drill rig auxiliary structure circuit 14, and any auxiliary heating circuit 15, as shown in FIGS. 5, 6, and 7.

The horizontal direction drill rig heating system 16 is now operational. The operator can adjust the heater 4 to a range of desired temperature settings along with controlling which circuits are to be supplied with warm fluid from the pump 3 via the on/off valves 5.

After starting the horizontal directional drill rig heating system 16, fluid from the fluid reservoir 1 supplies the pump 3 to allow an open system of fluid. The inverter 12 converts the horizontal directional drill rig 1 direct current electric system to alternating current to be able to run pump 3. Pump 3 sends the fluid to the heater 4 via hoses 6 as shown in FIG. 1. The fluid leaves the heater 4 at a temperature the operator sets it at, and is diverted to either the drill rig carriage structure 8, the auxiliary drill rig structure 9, the auxiliary heating components 10, or any combination thereof via the on/off valves 5, as shown in FIG. 1. The horizontal direction drill rig 1 now has warm working fluid flowing through open circuits 13, 14, and 15, as shown in FIGS. 1-7 to provide an efficient and open horizontal directional drill rig heating system 16.

As the pump 3 and heater 4 supply the drill rig carriage circuit 13 with warm fluid, as shown in FIGS. 1, 3, and 5, the temperature of the drill rig carriage structure 8 begins to increase based off the laws of heat transfer. The drill rig carriage structure 8 is now experiencing forced convection on the inside of the structural tubing, provided by the pump 3 and heater 4, that makes up the drill rig carriage structure 8, and the exterior part of the drill rig carriage structure 8 is radiating heat to near by components on the horizontal directional drill rig 1. Components that are utilizing the radiant heat transfer from the drill rig carriage structure circuit 13 are, but are not limited to, the drill rig carriage 7 and drilling rod 11, as shown in FIGS. 1, 2, 3, and 5.

As the pump 3 and heater 4 supply the auxiliary drill rig structure circuit 14 with warm fluid, as shown in FIGS. 1, 4, and 6, the temperature of the auxiliary drill rig structure 9 begins to increase based off the laws of heat transfer. The auxiliary drill rig structure 9 is now experiencing forced convection on the inside of the structural tubing, and the exterior part of the auxiliary drill rig structure 9 is radiating heat to proximate components on the horizontal direction drill rig 1. Components that are utilizing the radiant heat transfer from the drill rig auxiliary structure circuit 14 are, but are not limited to, the drill rig carriage 7, the drilling rod 11, and drilling rods 11 stored on the horizontal directional drill rig 1, as shown in FIGS. 1, 2, 4, and 6.

As the pump 3 and heater 4 supply the auxiliary heating circuit 15 with warm fluid, as shown in FIGS. 1, 3, and 7, the auxiliary heating components 10 begin to increase based off the laws of heat transfer. The auxiliary heating components 10 is now experiencing forced convection on the inside of the structural tubing on the horizontal directional drill rig 1. Components that are utilizing the heat transfer from the auxiliary heating components circuit 15 are, but are not limited to, the horizontal directional drill rig 1 engine compartment, fuel tank, hydraulic tank, and grease bucket holder.

What has been described and illustrated herein is a preferred embodiment of the invention along with some of its variations for the inventions possible circuitry on a horizontal directional drill rig 1. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

The invention claimed is:

1. A drill rig heating system (16) mounted to a horizontal directional drill rig (1) and is used for the removal of snow and ice buildup on said horizontal directional drill rig (1) comprising: said horizontal directional drill (1), a fluid reservoir (2), a pump (3), a heater (4), an inverter (12) to convert direct current from said horizontal directional drill to alternating current, and a series of on/off valve(s) (5) and hoses (6), wherein said pump circulates fluid from said fluid reservoir through a circuit connected by said valves and hoses, the circuit comprising said fluid reservoir, said heater, and at least one of a carriage structure of said horizontal directional drill rig, an auxiliary circuit of said horizontal directional drill rig and auxiliary components on said horizontal directional drill rig.

2. A method for removing snow and ice buildup on a horizontal direction drill rig (1) comprising: pumping a heating solution, via a pump (3), from a fluid reservoir (2), through a series of hose(s) (6) to a heater (4), to a series of on/off valves (5) which direct said heating fluid to a series of circuits in different internal structures comprising a carriage structure (8), an auxiliary structure (9) and auxiliary components (10) on said horizontal direction drill rig (1) to heat up said internal structures (8), (9) and (10), and back to said fluid reservoir (2) to continually repeat the process to remove snow and ice from said horizontal directional drill rig (1).

* * * * *